US008429774B2

(12) United States Patent
Tarsaud et al.

(10) Patent No.: US 8,429,774 B2
(45) Date of Patent: Apr. 30, 2013

(54) LATERAL TILT DEVICE

(75) Inventors: Jean-Francois Tarsaud, Peypin (FR); Sylvain Nozieres, Montpellier (FR); Florian Garnero, Castries (FR); Gilles Camus, Montpellier (FR); Thierry Flocard, Montpellier (FR)

(73) Assignee: Hill-Rom Industries SA, Montpellier (FR)

( * ) Notice: Subject to any disclaimer, the term of this patent is extended or adjusted under 35 U.S.C. 154(b) by 117 days.

(21) Appl. No.: 12/856,076

(22) Filed: Aug. 13, 2010

(65) Prior Publication Data

US 2011/0047703 A1 Mar. 3, 2011

(30) Foreign Application Priority Data

Aug. 31, 2009 (FR) ..... 09 55935

(51) Int. Cl.
*A47C 27/00* (2006.01)

(52) U.S. Cl.
USPC ..... 5/607; 5/715; 5/713

(58) Field of Classification Search ..... 5/706, 710, 5/715, 713, 607
See application file for complete search history.

(56) References Cited

U.S. PATENT DOCUMENTS

| | | | |
|---|---|---|---|
| 624,638 | A | 5/1899 | Fournier |
| 1,147,560 | A | 7/1915 | Shurtleff |
| 1,468,072 | A | 9/1923 | Ogle |
| 1,772,310 | A | 8/1930 | Hart |
| 2,245,909 | A | 6/1941 | Enfiajian |
| 2,415,150 | A | 2/1947 | Stein |
| 2,437,006 | A | 3/1948 | Simpson |
| 2,460,245 | A | 1/1949 | Summerville |
| 2,491,557 | A | 2/1949 | Goolsbee |
| 2,575,764 | A | 11/1951 | Morner |
| 2,604,641 | A | 7/1952 | Reed |
| 2,719,986 | A | 10/1955 | Rand |
| 2,998,817 | A | 9/1961 | Armstrong |
| 3,148,391 | A | 9/1964 | Whitney |
| 3,192,540 | A | 7/1965 | Swank |
| 3,199,124 | A | 8/1965 | Grant |
| 3,297,023 | A | 1/1967 | Foley |

(Continued)

FOREIGN PATENT DOCUMENTS

| | | |
|---|---|---|
| DE | 2249013 | 7/1974 |
| DE | 7522889 | 11/1975 |

(Continued)

OTHER PUBLICATIONS

European Search Report for EP 10 17 4022, dated Dec. 15, 2010, (4 pages).

*Primary Examiner* — Fredrick Conley
(74) *Attorney, Agent, or Firm* — Barnes & Thornburg LLP

(57) ABSTRACT

A lateral tilting device for a patient lying on a mattress is capable of being inserted between the mattress and a level bed base or bed frame on which the mattress rests. The lateral tilting device comprises at least two independent first and second inflatable cells, pneumatically independent and positioned at least partly symmetrically from one another in relation to a median axis of the tilting device. The lateral tilting device includes two 'U' shaped inflatable compartments that are fitted into one another. A method for the lateral tilting of the mattress includes inflating a said first or second cell and concomitant deflation of the other second or respectively first cell of the tilting device laid out under the mattress.

17 Claims, 3 Drawing Sheets

U.S. PATENT DOCUMENTS

| | | | |
|---|---|---|---|
| 3,303,518 | A | 2/1967 | Ingram |
| 3,317,934 | A | 5/1967 | Hinrichs |
| 3,363,941 | A | 1/1968 | Wierwille |
| 3,390,674 | A | 7/1968 | Jones |
| 3,394,415 | A | 7/1968 | Parker |
| 3,421,163 | A | 1/1969 | Stoughton |
| 3,426,373 | A | 2/1969 | Scott et al. |
| 3,446,203 | A | 5/1969 | Murray |
| 3,462,778 | A | 8/1969 | Whitney |
| 3,467,081 | A | 9/1969 | Glass |
| 3,477,071 | A | 11/1969 | Emerson |
| 3,485,240 | A | 12/1969 | Fountain |
| 3,492,988 | A | 2/1970 | DeMare |
| 3,587,568 | A | 6/1971 | Thomas |
| 3,595,223 | A | 7/1971 | Castagna |
| 3,605,138 | A | 9/1971 | Tucker |
| 3,605,145 | A | 9/1971 | Graebe |
| 3,644,950 | A | 2/1972 | Lindsay, Jr. |
| 3,653,083 | A | 4/1972 | Lapidus |
| 3,667,073 | A | 6/1972 | Renfroe |
| 3,670,347 | A | 6/1972 | Weinstein |
| 3,674,019 | A | 7/1972 | Grant |
| 3,678,520 | A | 7/1972 | Evans |
| 3,701,173 | A | 10/1972 | Whitney |
| 3,740,777 | A | 6/1973 | Dee |
| 3,757,356 | A | 9/1973 | Freeman |
| 3,762,404 | A | 10/1973 | Sakita |
| 3,775,781 | A | 12/1973 | Bruno et al. |
| 3,784,994 | A | 1/1974 | Kery |
| 3,795,021 | A | 3/1974 | Moniot |
| 3,822,425 | A | 7/1974 | Scales |
| 3,867,732 | A | 2/1975 | Morrell |
| 3,870,450 | A | 3/1975 | Graebe |
| 3,879,776 | A | 4/1975 | Solen |
| 3,909,858 | A | 10/1975 | Ducker |
| 3,919,730 | A | 11/1975 | Regan |
| 3,935,604 | A | 2/1976 | Collins |
| 3,949,438 | A | 4/1976 | Scales |
| 3,955,563 | A | 5/1976 | Maione |
| 3,978,530 | A | 9/1976 | Amarantos |
| 3,982,786 | A | 9/1976 | Burgin et al. |
| 4,005,236 | A | 1/1977 | Graebe |
| 4,068,334 | A | 1/1978 | Randall |
| 4,094,025 | A | 6/1978 | Nystad |
| 4,099,276 | A | 7/1978 | Hunt et al. |
| 4,132,228 | A | 1/1979 | Green |
| 4,136,413 | A | 1/1979 | Scales |
| 4,149,285 | A | 4/1979 | Stanton |
| 4,175,297 | A | 11/1979 | Robbins et al. |
| 4,185,341 | A | 1/1980 | Scales |
| 4,190,286 | A | 2/1980 | Bentley |
| 4,193,149 | A | 3/1980 | Welch |
| 4,197,837 | A | 4/1980 | Tringali et al. |
| 4,225,989 | A | 10/1980 | Corbett et al. |
| 4,267,611 | A | 5/1981 | Agulnick |
| 4,279,044 | A | 7/1981 | Douglas |
| 4,280,487 | A | 7/1981 | Jackson |
| 4,347,633 | A | 9/1982 | Gammons et al. |
| 4,391,009 | A | 7/1983 | Schild et al. |
| 4,422,194 | A | 12/1983 | Viesturs et al. |
| 4,428,087 | A | 1/1984 | Horn |
| 4,454,615 | A | 6/1984 | Whitney |
| 4,472,847 | A | 9/1984 | Gammons et al. |
| 4,483,030 | A | 11/1984 | Flick et al. |
| 4,488,322 | A | 12/1984 | Hunt et al. |
| 4,508,107 | A | 4/1985 | Strom et al. |
| 4,517,693 | A | 5/1985 | Viesturs |
| 4,525,885 | A | 7/1985 | Hunt et al. |
| 4,525,886 | A | 7/1985 | Savenije |
| 4,527,298 | A | 7/1985 | Moulton |
| 4,528,704 | A | 7/1985 | Wegener et al. |
| 4,534,078 | A | 8/1985 | Viesturs et al. |
| 4,541,136 | A | 9/1985 | Graebe |
| 4,542,547 | A | 9/1985 | Sato |
| 4,551,874 | A | 11/1985 | Matsumura et al. |
| 4,583,255 | A | 4/1986 | Mogaki et al. |
| 4,594,743 | A | 6/1986 | Owen et al. |
| 4,614,000 | A | 9/1986 | Mayer |
| 4,617,690 | A | 10/1986 | Grebe |
| 4,622,706 | A | 11/1986 | Takeuchi |
| 4,638,516 | A | 1/1987 | Vrzalik |
| 4,638,519 | A | 1/1987 | Hess |
| 4,642,825 | A | 2/1987 | Kurita |
| 4,653,130 | A | 3/1987 | Senoue et al. |
| 4,654,903 | A | 4/1987 | Chubb et al. |
| 4,662,012 | A | 5/1987 | Torbet |
| 4,686,719 | A | 8/1987 | Johnson et al. |
| 4,686,722 | A | 8/1987 | Swart |
| 4,688,283 | A | 8/1987 | Jacobson et al. |
| 4,694,520 | A | 9/1987 | Paul et al. |
| 4,697,290 | A | 10/1987 | Alklind et al. |
| 4,698,864 | A | 10/1987 | Graebe |
| 4,700,418 | A | 10/1987 | Ritter |
| 4,711,275 | A | 12/1987 | Ford et al. |
| 4,722,105 | A | 2/1988 | Douglas |
| 4,729,598 | A | 3/1988 | Hess |
| 4,745,647 | A | 5/1988 | Goodwin |
| 4,768,249 | A | 9/1988 | Goodwin |
| 4,797,962 | A | 1/1989 | Goode |
| 4,798,227 | A | 1/1989 | Goodwin |
| 4,799,276 | A | 1/1989 | Kadish |
| 4,803,744 | A | 2/1989 | Peck et al. |
| 4,825,486 | A | 5/1989 | Kimura et al. |
| 4,838,309 | A | 6/1989 | Goodwin |
| 4,840,425 | A | 6/1989 | Noble |
| 4,852,195 | A | 8/1989 | Schulman |
| 4,862,921 | A | 9/1989 | Hess |
| 4,864,671 | A | 9/1989 | Evans |
| 4,896,389 | A | 1/1990 | Chamberland |
| 4,907,308 | A | 3/1990 | Leininger et al. |
| 4,914,760 | A | 4/1990 | Hargest et al. |
| 4,914,771 | A | 4/1990 | Afeyan |
| 4,935,968 | A | 6/1990 | Hunt et al. |
| 4,941,221 | A | 7/1990 | Kanzler |
| 4,942,635 | A | 7/1990 | Hargest et al. |
| 4,944,060 | A | 7/1990 | Peery |
| 4,949,412 | A | 8/1990 | Goode |
| 4,949,413 | A | 8/1990 | Goodwin |
| 4,949,414 | A | 8/1990 | Thomas et al. |
| 4,953,247 | A | 9/1990 | Hasty |
| 4,962,552 | A | 10/1990 | Hasty |
| 4,967,431 | A | 11/1990 | Hargest et al. |
| 5,003,654 | A | 4/1991 | Vrzalik |
| 5,005,240 | A | 4/1991 | Vrzalik |
| 5,008,965 | A | 4/1991 | Vrzalik |
| 5,022,110 | A | 6/1991 | Stroh |
| 5,029,352 | A | 7/1991 | Hargest et al. |
| 5,035,014 | A | 7/1991 | Blanchard |
| 5,036,559 | A | 8/1991 | Hargest |
| 5,044,029 | A | 9/1991 | Vrzalik |
| 5,051,673 | A | 9/1991 | Goodwin |
| 5,052,067 | A | 10/1991 | Thomas et al. |
| 5,062,167 | A | 11/1991 | Thomas et al. |
| 5,065,464 | A | 11/1991 | Blanchard et al. |
| 5,065,466 | A | 11/1991 | Thomas et al. |
| 5,073,999 | A | 12/1991 | Thomas et al. |
| 5,090,074 | A | 2/1992 | Scales et al. |
| 5,090,077 | A | 2/1992 | Caden et al. |
| 5,092,007 | A | 3/1992 | Hasty |
| 5,095,568 | A | 3/1992 | Thomas et al. |
| 5,111,544 | A | 5/1992 | Graebe |
| 5,121,513 | A | 6/1992 | Thomas et al. |
| 5,138,729 | A | 8/1992 | Ferrand |
| 5,142,719 | A | 9/1992 | Vrzalik |
| 5,152,021 | A | 10/1992 | Vrzalik |
| 5,152,023 | A | 10/1992 | Graebe |
| 5,163,196 | A | 11/1992 | Graebe et al. |
| 5,168,589 | A | 12/1992 | Stroh |
| 5,182,826 | A | 2/1993 | Thomas et al. |
| 5,235,713 | A | 8/1993 | Guthrie |
| 5,249,318 | A | 10/1993 | Loadsman |
| 5,251,349 | A | 10/1993 | Thomas et al. |
| 5,269,030 | A | 12/1993 | Pahno et al. |
| 5,323,500 | A | 6/1994 | Roe et al. |
| 5,373,595 | A | 12/1994 | Johnson et al. |
| 5,375,273 | A | 12/1994 | Bodine, Jr. et al. |
| 5,388,292 | A | 2/1995 | Stinson |

| | | | | |
|---|---|---|---|---|
| 5,421,044 | A | 6/1995 | Steensen | |
| 5,487,196 | A | 1/1996 | Wilkinson et al. | |
| 5,586,346 | A | 12/1996 | Stacy et al. | |
| 5,611,096 | A | 3/1997 | Bartlett et al. | |
| 5,926,883 | A | 7/1999 | Rechin et al. | |
| 5,966,762 | A | 10/1999 | Wu | |
| 5,983,428 | A | 11/1999 | Hannagan | |
| 5,983,429 | A | 11/1999 | Stacy et al. | |
| 6,021,533 | A | 2/2000 | Ellis et al. | |
| 6,047,424 | A | 4/2000 | Osborne et al. | |
| 6,145,142 | A | 11/2000 | Rechin et al. | |
| 6,216,300 | B1 | 4/2001 | Hannagan | |
| 6,295,675 | B1 | 10/2001 | Ellis et al. | |
| 6,421,858 | B1 | 7/2002 | Cuerel | |
| 6,467,113 | B2 | 10/2002 | Ellis et al. | |
| 6,536,056 | B1 | 3/2003 | Vrzalik et al. | |
| 6,584,628 | B1 | 7/2003 | Kummer et al. | |
| 6,760,939 | B2 | 7/2004 | Ellis et al. | |
| 6,904,631 | B2 | 6/2005 | Vrzalik et al. | |
| 7,076,818 | B2 | 7/2006 | Kummer et al. | |
| 7,111,348 | B2 | 9/2006 | Ellis et al. | |
| 7,322,947 | B2 | 1/2008 | Flick et al. | |
| 7,346,945 | B2 | 3/2008 | Phillips et al. | |
| 7,353,556 | B2 | 4/2008 | Ellis et al. | |
| 7,398,573 | B2 | 7/2008 | Ellis et al. | |
| 7,469,436 | B2 | 12/2008 | Meyer et al. | |
| 7,698,765 | B2 | 4/2010 | Bobey et al. | |
| 7,802,332 | B2 | 9/2010 | Kummer et al. | |
| 2007/0143928 | A1* | 6/2007 | Biggie et al. | 5/715 |

FOREIGN PATENT DOCUMENTS

| | | | |
|---|---|---|---|
| DE | 2446935 | A1 | 4/1976 |
| DE | 7334397 | | 9/1976 |
| DE | 2522863 | A1 | 11/1976 |
| DE | 7639097 | | 7/1977 |
| DE | 2614861 | A1 | 10/1977 |
| DE | 2816642 | A1 | 10/1978 |
| DE | 2919438 | A1 | 11/1980 |
| DE | 3217981 | A1 | 11/1982 |
| DE | 3303615 | A1 | 8/1984 |
| DE | 3535374 | A1 | 4/1987 |
| DE | 3716263 | A1 | 11/1988 |
| DE | 9010880 | | 2/1991 |
| EP | 0 162 785 | A2 | 11/1958 |
| EP | 0 034 954 | A2 | 9/1981 |
| EP | 0 122 666 | A2 | 10/1984 |
| EP | 0 134 051 | A1 | 3/1985 |
| EP | 0 168 213 | A2 | 1/1986 |
| EP | 0 228 233 | A2 | 7/1987 |
| EP | 0 261 830 | A2 | 3/1988 |
| EP | 0 275 618 | A1 | 7/1988 |
| EP | 0 296 689 | A1 | 12/1988 |
| EP | 0 302 579 | A1 | 2/1989 |
| EP | 0 311 993 | A2 | 4/1989 |
| EP | 0 338 472 | A1 | 10/1989 |
| EP | 0 676 158 | A1 | 10/1995 |
| EP | 1 056 372 | A1 | 12/2000 |
| GB | 122806 | | 2/1919 |
| GB | 762528 | | 11/1956 |
| GB | 796746 | | 6/1958 |
| GB | 946831 | | 1/1964 |
| GB | 949652 | | 2/1964 |
| GB | 958651 | | 5/1964 |
| GB | 959103 | | 5/1964 |
| GB | 969367 | | 9/1964 |
| GB | 1023097 | | 3/1966 |
| GB | 1059100 | | 2/1967 |
| GB | 1118740 | | 7/1968 |
| GB | 1126364 | | 9/1968 |
| GB | 1222710 | | 2/1971 |
| GB | 1273342 | | 5/1972 |
| GB | 1286197 | | 8/1972 |
| GB | 1291015 | | 9/1972 |
| GB | 1341325 | | 12/1973 |
| GB | 1398544 | | 6/1975 |
| GB | 1440193 | | 6/1976 |
| GB | 1442994 | | 7/1976 |
| GB | 1474018 | | 5/1977 |
| GB | 1483045 | | 8/1977 |
| GB | 1499938 | | 2/1978 |
| GB | 1545806 | | 5/1979 |
| GB | 2026315 | | 2/1980 |
| GB | 1576641 | | 10/1980 |
| GB | 2059256 | | 4/1981 |
| GB | 1595417 | | 8/1981 |
| GB | 1599422 | | 9/1981 |
| GB | 1601808 | | 11/1981 |
| GB | 1602952 | | 11/1981 |
| GB | 2090734 | | 7/1982 |
| GB | 2107197 | | 4/1983 |
| GB | 2108837 | | 5/1983 |
| GB | 2134382 | | 8/1984 |
| GB | 2141333 | | 12/1984 |
| GB | 2167293 | | 5/1986 |
| GB | 2177594 | | 1/1987 |
| GB | 2177595 | | 1/1987 |
| GB | 2177906 | | 2/1987 |
| GB | 2183471 | | 6/1987 |
| WO | WO 84/04884 | | 12/1984 |
| WO | WO 86/05973 | | 10/1986 |
| WO | WO 86-06624 | | 11/1986 |
| WO | WO 89/03203 | | 4/1989 |

* cited by examiner

LATERAL TILT DEVICE

CROSS-REFERENCE TO RELATED APPLICATIONS

The present application claims priority, under 35 U.S.C. §119(a), of French National Application No. 0955935 which was filed Aug. 31, 2009 and which is hereby incorporated by reference herein.

BACKGROUND

The present disclosure concerns a support device comprising a mattress capable of supporting a patient in a lying position, as well as a device for laterally tilting said patient thus lying on the mattress. More specifically, this disclosure concerns a lateral tilting device capable of being inserted between said mattress and a base or frame of a bed or chair adapted for medical use upon which it rests.

It is known that a therapeutic support device can comprise a mattress resting or capable of resting on a base or frame, said mattress comprising a plurality of transversal inflatable cells, more or less cylindrical, each extending in a lateral direction perpendicular to the longitudinal direction of the mattress, said transversal cells being laid out side by side in the longitudinal direction of the mattress, the support device moreover comprising the means of inflating said cells and, preferably, the electronic means of regulating the air pressure within said cells, preferably also according to the morphology of the patient lying upon said mattress.

In some such support devices, each cell is equipped in a known manner with an air feed orifice and an air evacuation orifice, which communicate in a substantially airtight manner through hoses and by means of electromagnetic valves opening or closing said orifices, with an inflating device, such as a pump and electronic control devices of said pump and said electromagnetic valves.

The support devices of this type are used as mattresses for caring for patients, because they make it possible to ensure an adequate distribution of the interface pressure, that is to say, a pressure exerted locally by each point of the body on the surface of the mattress, according to the morphology and the position of the patients. Such mattresses specifically make it possible, as a function of the number of inflatable cells implemented, to individually control the pressure and thus the filling of the inflatable cells in the different areas of the mattress in order to obtain a redistribution of the interface pressure suited to the level of each of the parts of the body of a patient and to avoid or reduce the risk of formation of bedsores in a patient at risk, for example in the vulnerable regions of the body, such as the sacrum and the heels.

Theoretically, the ideal comfort of a patient and the optimum vascularization particularly for preventing the formation of bedsores or for reducing localized pain in certain support areas of the body on the mattress, are notably obtained when the support points of the body are redistributed over the surface of the mattress, that is to say, when the pressure exerted by the various areas of the body on the mattress (called "interface pressure") are more or less identical for all the of the body surface in contact with the mattress and, moreover, if such surface contact of the body with the mattress is as great as possible, which sometimes involves the adapting of the inflatable cells of the mattress under the various parts of the body to control the level of penetration of the body into the various areas of the mattress.

To accomplish this, the air pressure within the inflatable cells sometimes is distributed by controlling the filling/emptying of them according to certain pre-established calculations based on and according to the measurements made with sensors, in, on or under the mattress depending on the type of sensors utilized. Such sensors, known by people skilled in the art, can measure the pressure exerted by the patient's body or the penetration of the patient's body into the given compartments of the mattress, as described for example in the European patent EP 0 676 158 and European patent EP 1 056 372, as well as unpublished patent application FR 09 53758 filed on Jun. 5, 2009 (the US counterpart of which is U.S. application Ser. No. 12/781,426 filed May 17, 2010) describing pressure sensors comprising a capacitive measuring cell, on behalf of the claimant, each of which is hereby incorporated into this description by reference.

The control and regulation of the filling/emptying of the inflatable elements by means of electromagnetic valves also makes it possible to provide support devices functioning in the so-called "alternating pressure mode" in which certain inflatable cells of the support device regularly distributed over the length of the latter are alternately and simultaneously inflated and deflated. For example, one of two cells, or of three, or even of four is deflated/reinflated, then the adjacent cells to the previously deflated then reinflated cells are deflated/reinflated. Thus, each inflatable cell of the support device is successively deflated/reinflated from one cell to another, creating a sort of wave moving in the longitudinal direction of said device back and forth and relieving the interface pressure locally, facilitating at this point the vascularization of the soft tissue at the interface with the surface of the support device.

Some of the prior art support devices, specifically the mattresses, incorporating such inflatable cells consist, for example, of a first layer, the geometry of which in some instances is kept fixed due to the construction and which generally consists of an air mattress, the envelope of which is not elastic or of a foam bed, of a generally constant thickness throughout the mattress, forming a so-called lower mattress. A second layer lies on this, generally called a "therapeutic mattress," formed by juxtaposing inflatable cells, generally in the form of more or less cylindrical cells or rolls lying extended in a direction perpendicular to the longitudinal direction of the mattress, welded to one another over their length or only connected to one another at their ends in the transversal direction of the mattress. Each of the areas of the therapeutic mattress is equipped with electromagnetic valves and suitable hoses capable of being connected to an inflation and regulating device, generally independent of the mattress. The lower foam mattress layer, when there is such, and the therapeutic mattress layer consisting of inflatable cells are enclosed in a specially adapted slipcover to enable the filling and emptying of the inflatable rolls of the therapeutic mattress through its hoses connected to an attached inflation and regulating device.

Such mattresses with at least a partially inflatable structure make it possible to assist the prevention, and the effective and increased treatment of bedsores and other injuries or pain associated with keeping patients in a lying and nearly immobile position on hospital beds for a prolonged time, specifically through the implementation of alternating cycles of inflation/deflation of the cells of the therapeutic mattress and a use of differentiated inflation pressures of the cells in relation to the different support areas of the patient's body.

It is sometimes desirable to position the patient on their left side or right side, either to provide care, or to prevent the formation of bedsores or to reduce the localized pain in certain support areas of the body on the mattress, by modifying the location of such support zones through the alternate tilting or rotation of the body to one side then to the other. This practice is sometimes established as 30° lateral decubitus [reclining position] as described below.

To this end, attending staff may possibly use the blocks of foam of a specific shape supplied both as accessories or custom-built for each case, or else they use pillows or headboards that are placed in between the mattress and the patient, such that the body forms a 30° angle with the upper surface of the mattress, while benefitting from a back support and without the perineum contacting the mattress. In some instances, the legs are flexed in the area of the hips and the knees and wedged between them by cushions or foam shapes adapted so as to minimize the support risks between the bony projections. The upper leg is positioned behind the lower leg and flexed at 30° at the hip level and 35° at the knee level, for example.

It is known that some such prior art devices do not allow for the inclination of the mattress and to ensure the continuity of therapeutic performance in terms of pressure regulation of the various areas of the mattress, specifically in relation to the supporting side in the area of the bony projections, such as the large trochanter even between the bony projections themselves, particularly the knees and the ankle bones [malleolus], without interfering with the patient's movements, which can likewise compromise the therapeutic benefits sought or his/her safety in the event of a fall or entrapment in the spaces between the mattress and the bed.

Finally, repeated sequences of alternate lateral movements of the patient's body are not easily done and can possibly require, in some instances, attending personnel to be available to see that the patient remains comfortable in a lateral position for several hours. Moreover, it may be difficult to do, depending on the morphology and pathology of the patient, and may even cause a back injury for the attending personnel. Finally depending on the equipment used, for example, with foam forms, hygienic safety can be difficult to maintain and the material used can be lost, damaged or difficult to manage with respect to its storage and monitoring.

SUMMARY

This disclosure provides an improved type of support device, offering a patient functional lateral tilting, that is integrated into the mattress that is safe. It also can be controlled in terms of the incline angle of the mattress on which the patient lies on the one hand, and on the other, capable of being done cyclically according to the durations of the different stages of the cycle of alternated lateral tilting from one side to the other, in a controlled and reliable manner.

To this end, this disclosure offers a device for laterally tilting a patient lying on a mattress, capable of being inserted between said mattress and a bed base or bed frame on which said mattress lies, characterized in that said lateral tilting device comprises at least two first and second inflatable cells, pneumatically independent and positioned at least partially symmetrically to each other in relation to a median axis of said tilting device, the shape in the inflated state being capable of creating a lateral incline of the mattress when a first cell is inflated more than the second cell and a lateral incline sloping in the opposite direction when said second cell is inflated more then said first cell, said tilting device being inserted between the mattress and a bed base or bed frame on which it rests, with a median axis of said tilting device positioned so as to make it roughly coincide with a longitudinal median axis of said mattress.

By "pneumatically independent" herein, it is understood that said cells are capable of being inflated with air or deflated independently and differently from one another and if desired, independently and differently from the inflatable cells comprising said mattress under which the tilting device is inserted.

This disclosure likewise provides a support device comprising a mattress capable of supporting a patient in a lying position and a lateral tilting device according to the disclosed embodiments, the tilting device being laid out under the mattress inserted between a base or frame and the mattress, and said first and second cells extending in the longitudinal direction of the mattress.

Optionally, said mattress includes a plurality of pneumatically independent inflatable transversal cells and extends in a direction perpendicular to the longitudinal direction of the mattress and side by side in the longitudinal direction of the mattress, the pressure within said transversal cells capable of being regulated at a controlled pressure by means of inflation-deflation or electronically, in relation to the air pressure values measured in the cells and the morphology, the position and/or penetration of the patient into the mattress as determined by a sensor inserted between said mattress and said tilting device.

In some embodiments, said morphology and position sensor, for example a capacitive sensor type, is integrated into the mattress and subject to the same tilting as the latter. The morphology and position sensor, for example a capacitive sensor type, can also be capable of automatically determining the tilt angle before it begins. In any event, a support device according to the present disclosure potentially includes a way of controlling the tilt angle either through support information coming from said morphology and position sensor, or by direct measurement of the angle or any other appropriate means.

In some contemplated embodiments, said mattress comprises said transversal cells resting on a lower mattress or a lower layer preferably consisting of cell(s) filled with air, said tilting device being inserted between said bed frame or bed base and under the mattress.

This disclosure likewise provides a lateral tilting method for a support device characterized in that the tilting of said mattress is done by inflating a said first or second cell and concomitant deflating of the other second or respectively first cell of said tilting device laid out under said mattress.

In some embodiments of the lateral tilting device according to this disclosure, each cell includes at least 2 longitudinal form compartments, preferably more or less cylindrically shaped, of the roll type, the two compartments of each said cell of each group not being laid out symmetrically to one another in relation to the median axis of said tilting device, and the compartment of each said first or second cell closest to the median axis of said tilting device having a lower height than that of the other compartment of the same inflated cell, so as to create the lateral incline of the mattress when said tilting device is inserted between said mattress and said bed base or bed frame, with the median axis of said tilting device positioned so as to make it roughly coincide with the medium longitudinal axis of said mattress.

It is therefore possible that, in a lateral tilting method of the support device according to the present disclosure, when each cell of the tilting device includes two compartments, as described above, the height of the small compartment of the inflated cell is higher than the height of the large compartment of the other deflated cell preferably located on the same side of the median axis of the tilting device following the deflation, such that an incline of the mattress is obtained following a concomitant inflation-deflation of the two cells.

Other forms of cells for a tilting device were tested, single large compartments rather than being paired with small compartments and/or large compartments were paired with adjacent small compartments that create a less homogeneous incline of the mattress, which could be harmful to the stability and the safety of the patient, or do not create the sought inclined plane.

More specifically with regard to some embodiments, in a lateral tilting device according to the present disclosure, said first and second cells extend to a length at least equal to ⅔, preferably at least to ¾ of the length of said mattress, more preferably the length of said first and second cells is at least 1.50 m. Such a length of the cells of the tilting device according to some embodiments of this disclosure, extending over almost the entire length of the body of a patient lying on said mattress makes it possible to avoid the risks of twisting with potentially negative effects on the patient in the case of a cell extending over a shorter length.

According to some other aspects and characteristics of a tilting device according to some embodiments contemplated by this disclosure: the compartments of greater height and compartments of lesser height of each of said first and second cells are located on either end of said longitudinal median axis of the tilting device, and the two compartments of the same said first or second cell communicate pneumatically between one another. In other embodiments, the two compartments of each cell can be pneumatically independent.

In some embodiments of a lateral tilting device according to the disclosure, the latter includes two first and second cells joined with one another, said cells each including at least two compartments communicating with one another, the two compartments of each cell defining a 'U' with branches laid flat, including in the inflated state:

(i) a large external branch or large compartment longer and larger in diameter than a small internal branch or small compartment, said large and small branches being joined and communicating pneumatically with one another through a junction area extending transversally to one of their longitudinal ends, (ii) the two 'U's being fitted into one another such that the small branch or small compartment of each cell is inserted between the two branches or compartments of the other cells; the edges of said small branch of each cell are joined with the edges of the two branches of their said junction area of the other cell, and (iii) the small branch and the large branch of each cell being located on either side of the median axis of the tilting device, the adjacent internal longitudinal edges of the two small branches of the two said first and second cells being connected to one another along the median axis of the tilting device.

The embodiments of the type mentioned in the preceding paragraph can potentially be advantageous in terms of the manufacturing cost. For example, the first and second cells can be mechanically unified with one another through heat-sealing lines of two sheets of plastic material or of cloth coated with plastic material, one against the other, or one sheet of plastic material or of cloth coated with plastic material folded on itself, with said heat-sealed lines forming in addition at least two said compartments, communicating with at least two said junction areas extending transversally between each of said compartments of each of the two cells permitting pneumatic communication between the two compartments at one of their longitudinal ends. In another contemplated embodiment, the junction areas between the two compartments are not formed by heat-sealing of said sheets or of plastic material or cloth coated with plastic material, but by a single hose fixed to the sealing orifices on each of the two said compartments at each of the ends of said hose.

In some embodiments having means of inflation-deflation including at least a pump, inflation-deflation orifices of said first and second cells and independent pneumatic means of communication, such as hoses between said pump and said orifices, are provided and said means of inflation includes an automatic electronic regulating device for the alternating inflation-deflation of the two first and second cells capable of controlling the inflation of a cell and concomitant deflation of the other cell, and successively inflating then deflating each said first and second cell according to cycles of different possible durations, such as with time durations from 30 seconds to 4 hours maintaining the inflated state of each cell and maintaining the deflated state.

More specifically, with regard to some embodiments, the respective height of each said first and second cell at the maximum inflation and respectively minimum state permits a said lateral incline of at least 20°, preferably 25°. This incline is sufficient to completely tilt a patient to one side. For example, the convex pumped upper faces of the two compartments are more or less tangent to a straight line inclined with respect to the horizontal with an angle up to at least 20°, preferably 25°, when the lower faces rest on a horizontal plane.

The embodiments according to the present disclosure can likewise be used in an alternated tilting method, wherein an inflation-deflation cycle is implemented for each said first and second cell successively, to perform the lateral tilts of said mattress alternately on each side, the lateral incline of the mattress possibly being tilted at 4 to 8°, to 5 to 7°, with said cells of the tilting device being inflated at a regulated pressure, like the transversal cells of said mattress, said regulated pressure being still differentiated according to the areas of the mattress in the longitudinal direction of said mattress. This allows for an automated sequential lateral releasing of the support points of the patient on the mattress without creating hyper-pressure.

The sensor thus remains activated to regulate the pressure within the mattress, like that within the inflated cell of the tilting device at the determined inflation pressure. And, the morphology and position sensor according to some embodiments of the present disclosure make it possible to ensure the continuity of therapeutic benefits, a low angulation and the safety of the patient at the time of the tilting.

This relatively low angle actually makes it possible to prevent risks of abrasion or cutting the soft tissue of the patient, and an alternating lateral incline of 5 to 7° likewise makes it possible to keep the patient safe, as the risk of falling is not increased with respect to the flat position. Optionally, in this method according to the present disclosure, the alternating tilting cycles are performed with durations of time from 1 to 3 hours, where the inflated state of each of the first and second cells is maintained, and then the first and second cells are maintained in the deflated state.

In each particular implementation mode, said cells may be comprised of plastic material, such as PVC or PU (polyurethane) or of cloth coated with plastic such as PVC or PU.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
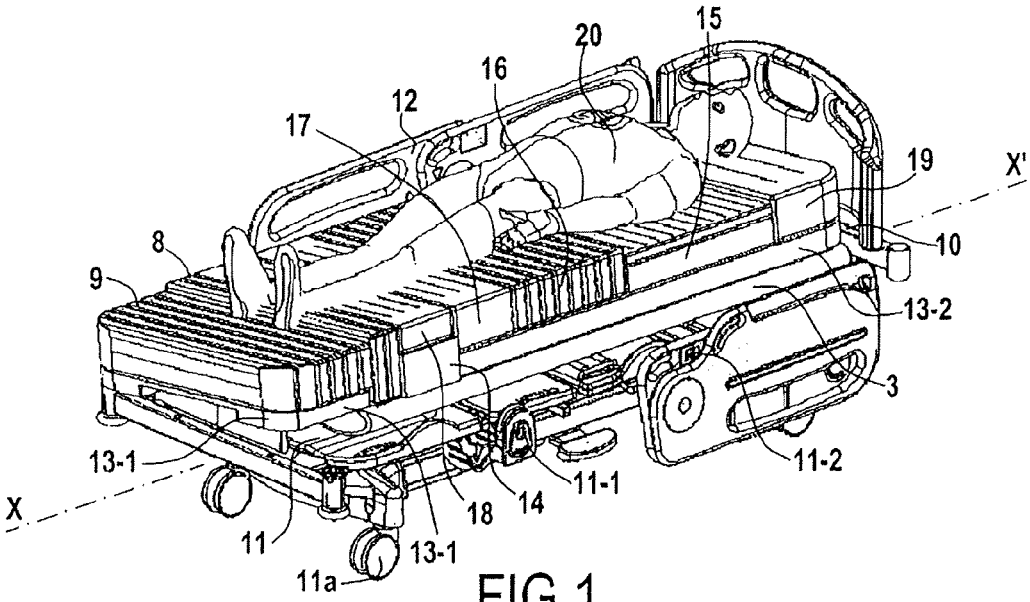
FIG. 1 is a perspective view of a bed comprising a level frame on which rests a tilting device according to the present disclosure inserted between a mattress and said frame, a patient resting lying on said mattress, the tilting device being inflated to produce an incline of said mattress and of said patient.

FIG. 1 shows a perspective view of a bed adapted for medical use comprising a level frame 11 mounted on casters 11*a*, equipped with lateral barriers 12 and on which a therapeutic support device 10 rests, consisting of the following elements:

- a series of transversal cells extending in the YY' direction perpendicular to the longitudinal XX' direction, that is:
  - one or more transversal cells comprising a head area 19, and
  - one or more transversal cells comprising a back support area 15,
- a plurality of pneumatically and mechanically independent transversal cells juxtaposed one against the other in the longitudinal XX' direction, comprising a central support area 16, called the "sacrum area,"
- one or more transversal cells comprising the thigh support area 17, and
- one or more transversal cells comprising a calf support area 18, and
- a plurality of pneumatically and mechanically independent transversal cells juxtaposed in parallel one against the other in the longitudinal XX' direction, comprising an end area for heel support 9, and
- an area called "retractable area" 8 of variable dimensions, including four pneumatically independent inflatable transversal cells, said area being inserted between the heel area 9 and the calf area 8, so as to be able to position the heel area 9 by translation movement of it with respect to the heels of the patient lying on the bed, as a function of the reduction of number of cells kept in the inflated state in the retractable area 8.

The different cells of areas 19, 15, 16, 17 and 9 are respectively supported by two lower mattresses 13-1 and 13-2, while the calf support area 18 is supported by a service unit 14 containing an air feed pump and electronic means of control of the opening of the electromagnetic air feed and air evacuation valves of the various pneumatically independent cells, as well as the electronic controls for regulating the pressure in relation to the air pressure measurements within the cells and an interface pressure measurement given by a sensor 5 placed in a known manner under the sacrum area, in the space under the lower mattress 13-2 in a central position of the sacrum area 16, enabling the providing of data relating to the morphology of the patient as a function of the penetration of the patient into said mattress, as determined by said sensor. It is particularly possible to use a capacitive sensor as described in application FR-09 53758 filed on Jun. 5, 2009 on behalf of the claimant incorporated in this description as a reference.

FIG. 1 likewise depicts a lateral tipping from the right side of the patient by means of a lateral tilting device according to device 3, which is placed below lower-mattress 13-1, 13-2. This tilting device 3 extends from the head end of the mattress under the head area up to a part of the heel area, which represents an approximate length of 2.10 m here. Actually, the lateral tilting device 3 extends the entire length of the mattress when retractable area 8 is inserted between the calf support area 18 and the heel support area 9 is completely deflated, heel support end area 9 being moved by lateral translation against calf support area 18.

Figure 3:
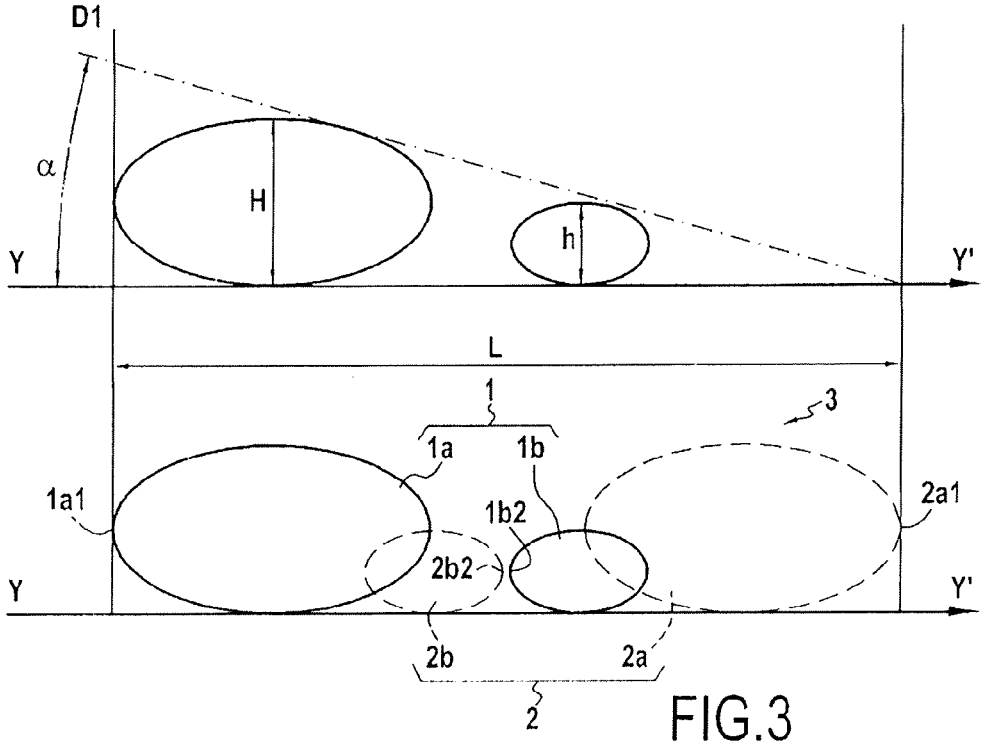
FIG. 3 is a diagrammatic sectional view of a device according to FIG. 2, in which the two first and second cells and the two compartments of each of the two first and second cells are inflated (one shown in solid line and one shown in dotted line).
Figure 2:
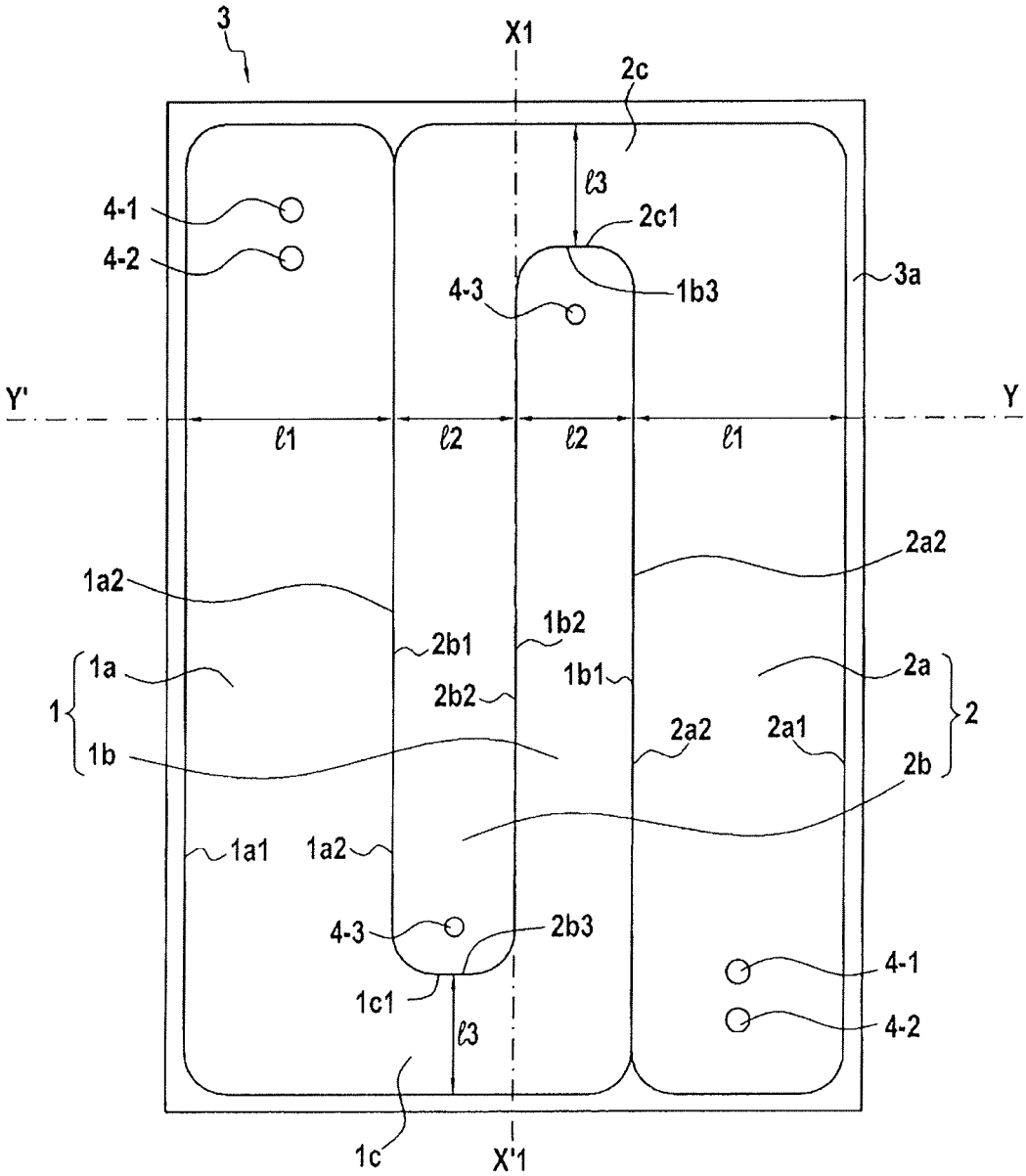
FIG. 2 is a top plan view of a deflated lateral inclining or tilting device according to the present disclosure, having two first and second cells in the shape of a 'U' laid out in a manner fitting into one another, the different longitudinal edges of the two branches, each in a 'U,' comprising two compartments of said first and second cells, which are joined with one another by heat-sealing lines of two sheets of plastic material or of cloth coated with plastic material welded one against the other, or a single sheet folded onto itself and welded onto itself in the area of said sealing lines.

FIGS. 2 and 3 depict lateral tilting device 3 according to this disclosure, including two pneumatically independent air-inflatable first and second cells 1, 2, that is to say each including two air feed 4-1 and evacuation 4-2 orifices and one escape orifice 4-3, making it possible to more precisely regulate the air pressure within each of the two cells. The two first and second cells 1, 2 each include two compartments 1*a*-1*b* and 2*a*-2*b* extending into the longitudinal X1X'1 direction of tilting device 3 spaced one from the other in the transversal YY' direction.

Figure 4:
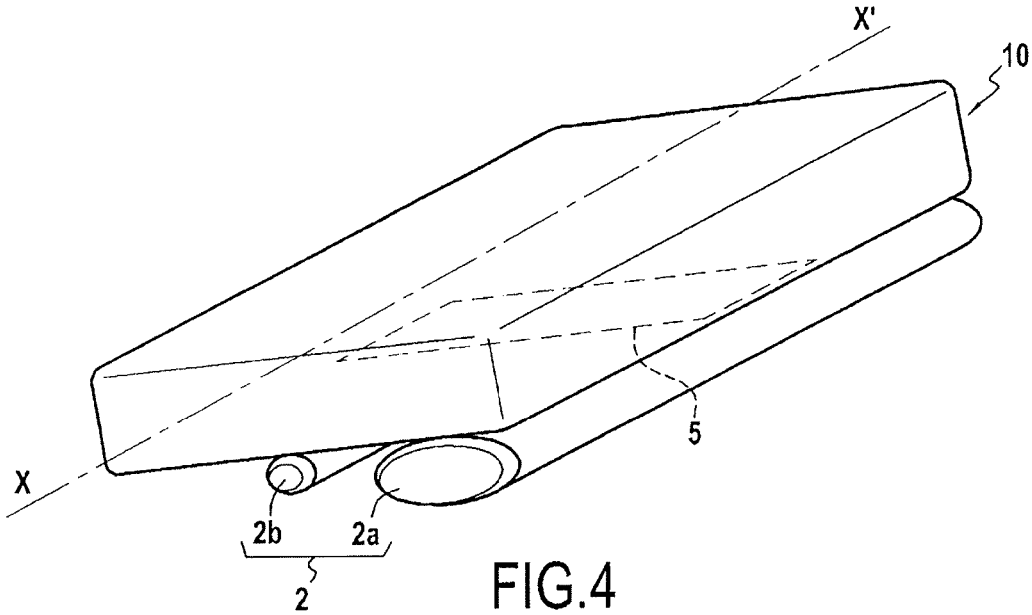
FIG. 4 is a diagrammatic perspective view of an inclining and tilting device according to the present disclosure laid out under the mattress and in which only one of said first and second cells is inflated so as to produce a lateral incline or tilting of one side, a sensor (in phantom) being inserted between said mattress and said tilting device in the area of the sacrum area cells of the mattress.

The two compartments 1*a*, 2*a*, 1*b*, 2*b* of each cell 1, 2 exhibit a more or less cylindrical axial shape extending in parallel to the X1X'1 direction with a roughly oval transversal section, as depicted in FIG. 4. Each said first and second cells 1, 2 exhibits a large compartment 1*a*, 2*a* and a small compartment 1*b*, 2*b*.

Each of these two large compartments 1*a*, 2*a* exhibits a maximum dimension in the transversal YY', direction, I1=47 cm and each said small compartment 1*b*, 2*b* exhibits a maximum dimension in the transversal YY' direction, I2=26 cm. The maximum width dimensions of the large and small compartments given above correspond to the width of the compartment in the completely deflated state, upper and lower faces of each compartment being laid out flat one on top of the other.

It is known that the width of said compartments is progressively reduced as they inflate, such that once said tilting device is inflated with its longitudinal median X1X'1 axis coinciding with the longitudinal median XX' axis of the mattress, the tilting device does not exceed the width of said mattress.

The fact that the small compartment of each cell is located on the other side of the median X1X'1 axis of the device in relation to the other compartment, with the small compartment of each cell positioned just after the median X1X'1 axis and the large compartment of each cell positioned in the vicinity of the outside edge of the mattress, makes it possible to create an optimal lateral incline of the mattress while preventing the formation of a cup in the area of the median X1X'1 axis of the mattress. Such a cup could be created if the two compartments of each cell were located on the same side in relation to the median axis X1X'1 of said tilting device and thus in relation to the longitudinal median XX' axis of the mattress.

The large and small compartments of each cell are spaced in the transversal YY' direction of a length L2. The small compartments 1*b* and 2*b* are smaller than the large compartments 1*a* and 2*a* of a length L1 of a maximum dimension equal to 30 cm. The large and small compartments of each cell communicate with one another at their longitudinal ends through a transversal junction area 1*c*, 2*c* forming two 'U' shaped cells with the two large and small compartments of each cell.

The two 'U' cells 1, 2 are fit into one another such that the small branch or small compartment 1*b*, 2*b* of each cell 1, 2 is inserted between the two branches or compartments 2*a*-2*b*, 1*a*-1*b* of the other cell, the edges of said small branch 1*b*-1, 1*b*-2 and 2*b*-1, 2*b*2 of each cell being joined with the internal longitudinal edges 1*a*2, 1*b*2 and 2*a*2, 2*b*2 of the 2 branches of the other cell.

A thus designed tilting device is noteworthy, because it can be easily manufactured by heat-sealing two sheets of plastic material or cloth coated with plastic material, together particularly polyurethane coated cloth, such that the weld lines simultaneously define the circumference 3*a* of the two cells and the connection line between the two cells.

Thus, internal longitudinal edges 1*a*2 and 2*a*2 of the large branches 1-2 and 2*a* are joined to external longitudinal edges 2*b*1 and 1*b*1 of small branches 2*b* and 1*b* of the other cell. And internal longitudinal edges 1*b*2 and 2*b*2 of each small compartment are joined to one another. In addition, internal edge 1*c*1-2*c*1 of each transversal junction area 1*c*, 2*c* of each cell is joined to the transversal edge 1*b*3, 2*b*3 of longitudinal end of the small compartment comprising the small branch of the 'U' of the other cell.

The weld line between the two internal edges 1*b*2, 2*b*2 of the two small compartments 1*b*, 2*b* coincide with the longitudinal median X1X'1 axis of device 3, such that when tilting device 3 is positioned under a mattress 10, causing longitudinal X1X'1 axis of the tilting device to coincide with longitudinal XX' axis of the mattress with at least one of first and second cells 1, 2 inflated to the maximum, tilting device 3 exhibits a width L slightly less than the width of the mattress, in the space here less than 85 cm, in the maximum inflation position of one of the 2 cells 1 or 2 only, the heights H and h of the large compartments 1*a*, 2*a* and small compartments 1*b*, 2*b*, being H=30 cm and h=10 cm.

FIG. 4 schematically depicts the lateral tilting, onto the patient's left side achieved by inflating the second cell 2 and deflating the first cell 1. The outside edge 2*a*-1 of large branch 2*a* reaches the proximity of the lateral edge closest to the mattress and internal edge 2*b*2 of small branch 2*b* reaches the area of the median XX' axis of mattress 10.

To laterally tilt from the other side, outside edge 1*a*-1 of large branch 1*a* of the other cell, reaches the proximity of the lateral edge closest to the mattress and internal edge 1*b*-2 of small branch 1*b* of the other cell, which reaches the area of the median action XX' axis of the mattress.

They are inflated to the maximum to obtain the maximum heights H and h of the large and small compartments of one of the cells to facilitate the complete lateral tilting of a patient onto the one side with an incline of the mattress of $\alpha$=20 to 25° for the purpose of providing specific care to the patient.

However, this embodiment provides a comfortable method of treating the patient through an alternating lateral tilting procedure by alternate inflation of each of the two first and second cells 1, 2, the other being deflated or in any case less inflated, as is particularly apparent in view of the diagram of FIGS. 3 and 4, wherein to facilitate the tilting, the height of the large compartment after inflation of a first cell is greater than the height of the small compartment of the other less inflated or deflated cell located on the same side of the median X1X'1 axis of the tilting device and particularly since the height of the deflated large compartment of the other cell is smaller than the height of the small compartment of the first inflated cell.

Straight line D1 tangent to the two large and small compartments of each inflated cell form an angle $\alpha$ to the horizontal, of a maximum of 20 to 25°, which is sufficient to produce the complete tilting of a patient onto the side. And, in the case of a treatment for comfort intended solely to alleviate or prevent the risk of appearance of bedsores, alternate tilts with an incline of 5 to 7° of the right side and of the left side are sufficient.

Figure 5:
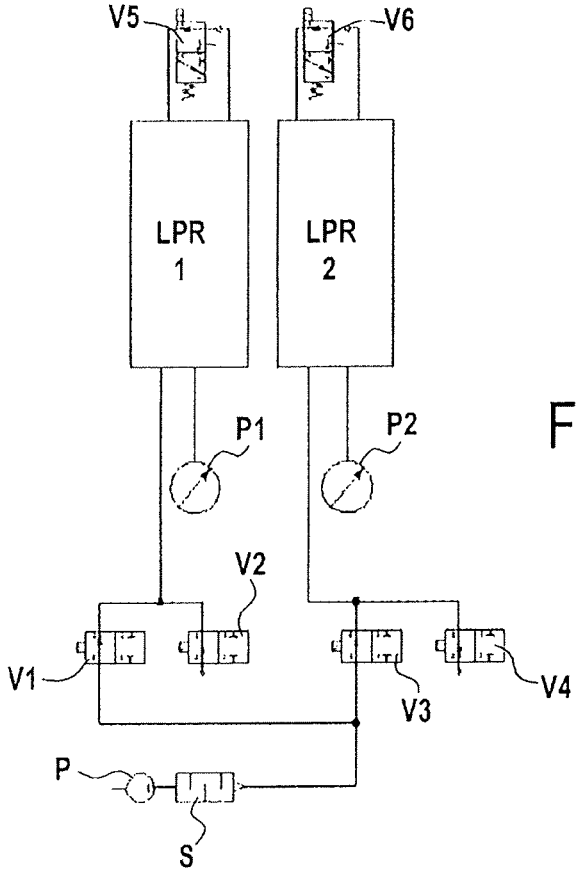
FIG. 5 is a schematic view of the electronic arrangement principle in which: LPR1 and LPR2 depict the first cell 1 and second cell 2, P1 and P2 depicts the pressure detections and measurements within said cells 1 and 2, V1 and V2 are respectively the electromagnetic feed 4-1 of cell 1 and emptying 4-2 valves of cell 1, V3 and V4 are electromagnetic feed 4-1 of cell 2 and emptying 4-2 valves of cell 2, respectively, V5 and V6 are the control valves at the escape of cell 1, 4-3 and regulation at the escape from cell 2, 4-3, P is the pump enabling the pressure feed of said cells according to the present disclosure, as well as the other cells of the mattress, and S is a noise emission limiter for the patient's comfort.

FIG. 5 depicts the skeleton diagram of the electronic wiring, encompassing the two cells 1, 2 of device 3, that the pumps and electromagnetic valves are contained inside service unit 14, whereas the hoses are contained in a distribution duct (not shown) positioned laterally on each side of mattress 10.

It is clear that depending on the degree of inflation of the different cells and according to the internal air pressure within the two cells 1, 2, it is possible to produce a controlled inclining of the bedridden patient on an air mattress regulated at the control pressure; the inflation of the two first and second cells of tilting device 3 according to the present disclosure can be controlled entirely automatically and sequentially.

Tilting device 3 is joined on the under face of mattress 10, if desired of lower mattress 13-1, by a longitudinal zipper (not shown), so that the two X1X'1' axes of tilting device and XX' of the mattress coincide. Thus, during inflation (or deflation) only a lateral half of the device, including the large compartment of one cell and the small compartment of the other change their overall width, the large compartment once inflated being always entirely located under the mattress by reduction of its width in conjunction with the increase of its height.

The cycle, that is the time period of maintaining each position, can be controlled automatically. And the pressure of therapeutic mattress 10 can likewise be controlled automatically by means of sensor 5, which remains active even during the lateral tilting, because the overall width of each inflated cell exceeds the longitudinal median XX' axis of the mattress from the longitudinal lateral edge of the most distant mattress. Patient 20 thus rests the entire time on an active therapeutic surface 10. Barriers 12 and alarms (not shown) can be activated during the cycle time of an alternate tilting procedure to prevent the patient from possibly falling from mattress 10.

Optionally, the two cells 1, 2 can be inflated to the same control pressure as that of mattress 10, in the region of the sacrum area, which is determined and controlled in connection with sensor 5 controlling the immersion of patient 20, specifically an ultra flat and shapeable capacitive sensor, as described in FR 09 53758 (the US counterpart of which is U.S. application Ser. No. 12/781,426).

The purpose of the lateralization controlled by immersion sensor 5 is to reduce the interface pressure of one side of the patient, while ensuring adequate distribution of the support points over the opposite side that carries him/her, while preventing the creation of significant interface pressure points, the lateralization angles α in the in the alternating tilt procedure are small, from 5 to 7°, so as to avoid risks of abrasion and of cutting the soft tissue of the patient 20.

The two large and small compartments of each deflated cell are made virtually flat at the same time through activation of the large-flow electromagnetic valves, the patient's weight serving as additional support.

By default, the stages of the cycle are: lateralization to the right by inflating the first cell 1, reflattening of the first cell 1, lateralization to the left by inflating the second cell 2, reflattening of the first cell 2, and so on.

The time they are maintained in each stage is standardized at 2 hours by default. The sequences and duration times can be customized by the attending personnel, for example, in 30 minute increments.

Certain stages can be eliminated and a following sequence, for example, can be devised for which the right lateralization is maintained for a longer time than the left lateralization, for example 3 hours on one side and 2 hours on the other.

Sensor 5 remains active at the time of the lateralization, because it is dimensionally ultra-thin and shapeable, thus suited to such lateralization.

Sensor 5 can likewise be used to determine and control the value of the incline angle α of tilting device 3 at its maximum inflation pressure corresponding to said control pressure.

Although certain illustrative embodiments have been described in detail above, many embodiments, variations and modifications are possible that are still within the scope and spirit of this disclosure as described herein and as defined in the following claims.

The invention claimed is:

1. A lateral tilting device for tilting a patient, the lateral tilting device comprising first and second inflatable cells, pneumatically independent, and positioned at least partly symmetrically to one another in relation to a median axis of said tilting device, wherein each of the first and second inflatable cells are U-shaped and fitted into one another such that a portion of each of the first and second inflatable cells is nested within the U-shape of the other of the first and second cells without the first and second inflatable cells overlapping, wherein a first lateral incline of the mattress is created when the first cell is inflated more than the second cell and a second lateral incline with a slope in an opposite direction to that of the first lateral incline when said second cell is inflated more than said first cell, and wherein the median axis intersects each of the first and second inflatable cells.

2. The lateral tilting device of claim 1, wherein each cell of the first and second inflatable cells comprises two compartments with longitudinal shape, the two compartments of each said cell of the first and second inflatable cells being shaped such that each compartment of said first and second cells closest to the median axis of said tilting device have a lower height than that of the other compartment of the same cell of the first and second inflatable cells in the inflated state.

3. The lateral tilting device of claim 2, wherein said first and second inflatable cells extend over a length of at least 1.5 meters.

4. The lateral tilting device of claim 2, wherein the compartments of greater height and the compartments of lesser height of each of said first and second inflatable cells are located on either side of said longitudinal median axis of the lateral tilting device.

5. The lateral tilting device of claim 2, wherein the two compartments of each of the first and second inflatable cells communicate between each other pneumatically.

6. The lateral tilting device of claim 2, wherein the respective height of each said first and second inflatable cells in the maximum and respectively minimum inflation state permits said first and second lateral inclines of about 20° to about 25°.

7. The lateral tilting device according to claim 1, wherein the first and second inflatable cells are joined to one another.

8. The lateral tilting device of claim 7, further comprising means of inflation-deflation including at least one pump, inflation-deflation orifices of said first and second inflatable cells and means of independent pneumatic communication between said pumps and said orifices, and said means of inflation-deflation comprising an automatic electronic regulating device for alternate inflation-deflation of the first and second inflatable cells capable of controlling the inflation of one cell and concomitant deflation of the other cell and successive inflation, then deflation of each said first and second inflatable cell according to cycles of different durations, with time durations for maintaining the inflated state of each cell and maintaining the deflated state from about 30 seconds to about 4 hours.

9. The lateral tilting device according to claim 7, wherein the first and second inflatable cells are joined mechanically to one another by heat-sealing lines of two sheets comprising plastic material, one against the other, or a sheet comprising plastic material folded onto itself, said heat-sealing lines forming the at least two compartments of the first and second inflatable cells.

10. The lateral tilting device according to claim 1, wherein said first and second inflatable cells comprise a plastic material including at least one of PVC or PU (polyurethane).

11. The support device of claim 1, wherein the each of the first cell and the second cell is formed to include a first branch, a second branch spaced apart from and extending parallel to the first branch, and a transversal junction area extending between and interconnecting the first branch and the second branch, and the transversal junction area of the first cell is spaced apart from the transversal junction area of the second cell.

12. A support device comprising a mattress capable of supporting a patient in a lying position, and a lateral tilting device for tilting a patient, the lateral tilting device comprising first and second inflatable cells, pneumatically independent, and positioned at least partly symmetrically to one another in relation to a median axis of said tilting device, wherein each of the first and second inflatable cells are U-shaped and fitted into one another such that a portion of each of the first and second inflatable cells is nested within the U-shape of the other of the first and second cells, wherein a first lateral incline of the mattress is created when the first cell is inflated more than the second cell and a second lateral incline with a slope in an opposite direction to that of the first lateral incline when said second cell is inflated more than said first cell, wherein the median axis intersects each of the first and second inflatable cells, the tilting device being situated under the mattress, said first and second inflatable cells each including a pair of compartments extending in a longitudinal direction of the mattress, wherein the first and second inflatable cells are located entirely within the footprint of the mattress when viewed from above.

13. The support device of claim 12, wherein each of the first and second cells are nested within the U-shape of the other of the first and second cells without overlapping the other of the first and second cells.

14. A method of lateral tilting of a support device according to claim 12, wherein the tilting of said mattress is produced by inflation of one of said first and second inflatable cells and concomitant deflation of the other of said first and second inflatable cells of said tilting device laid out under said mattress.

15. The method of claim 14, wherein an inflation-deflation cycle of each said first and second inflatable cell is realized successively to produce the lateral tilts of said mattress alternately of each side, by laterally inclining the mattress by about 4° to about 8° tilt, with said first and second inflatable cells being inflated to a regulated pressure.

16. The support device according to claim 12, wherein said mattress comprises a plurality of pneumatically independent inflatable transversal cells extending in a direction perpendicular to the longitudinal direction of the mattress and side by side in the longitudinal direction of the mattress, the pressure within said transversal cells being capable of being regulated by means of inflation-deflation and electronically according to the air pressure values measured in the cells and the position and/or penetration of a patient into said mattress as determined by a sensor inserted between said mattress and said tilting device.

17. The support device of claim 16, wherein said mattress of said transversal cells rests on a lower mattress comprising air filled cells, said tilting device being situated beneath said lower mattress.

* * * * *